US006639169B2

(12) United States Patent
Matsui et al.

(10) Patent No.: US 6,639,169 B2
(45) Date of Patent: Oct. 28, 2003

(54) CONTACT FOR VACUUM INTERRUPTER AND VACUUM INTERRUPTER USING THE CONTACT

(75) Inventors: Yoshihiko Matsui, Shizuoka (JP); Hidemitsu Takebuchi, Chiba (JP); Akira Nishijima, Shizuoka (JP)

(73) Assignee: Kabushiki Kaisha Meidensha, Tokyo (JP)

( * ) Notice: Subject to any disclaimer, the term of this patent is extended or adjusted under 35 U.S.C. 154(b) by 0 days.

(21) Appl. No.: 10/238,900

(22) Filed: Sep. 11, 2002

(65) Prior Publication Data

US 2003/0080093 A1 May 1, 2003

(30) Foreign Application Priority Data

Sep. 12, 2001 (JP) ..... 2001-276171
Sep. 26, 2001 (JP) ..... 2001-293440

(51) Int. Cl.[7] ..... H01H 33/66
(52) U.S. Cl. ..... 218/128; 218/123
(58) Field of Search ..... 218/123, 124, 218/125, 126, 127, 128, 129

(56) References Cited

U.S. PATENT DOCUMENTS 4,532,391 A * 7/1985 Bernt ..... 218/128
4,620,074 A 10/1986 Paul et al.
4,695,687 A * 9/1987 Grosse et al. ..... 218/127
4,935,588 A * 6/1990 Hess et al. ..... 218/123
5,064,976 A * 11/1991 Bialkowski et al. ..... 218/127
5,612,523 A * 3/1997 Hakamata et al. ..... 218/128
5,804,788 A 9/1998 Smith

FOREIGN PATENT DOCUMENTS

DE 37 24 813 A1 2/1989
JP 3-59531 9/1991

OTHER PUBLICATIONS

U.S. patent application Ser. No. 10/238,897, Nishijima et al., filed Sep. 11, 2002.
U.S. patent application Ser. No. 10/238,901, Nishijima et al., filed Sep. 11, 2002.

* cited by examiner

*Primary Examiner*—Elvin Enad
*Assistant Examiner*—M. Fishman
(74) *Attorney, Agent, or Firm*—Foley & Lardner

(57) ABSTRACT

A contact and a vacuum interrupter using the contact. The contact includes a hollow cylindrical contact carrier and a contact plate disposed on one of the axial end faces of the contact carrier. First slits and second slits extend from the one of the axial end faces of the contact carrier and the other thereof, respectively. The first slits and the second slits are inclined with respect to the center axis of the contact carrier and have a first height x and a second height y extending in the axial direction of the contact carrier, respectively. Assuming that the axial length of the contact carrier is 1, the first height x and the second height y satisfies a relationship given by the following expressions (1)-(3): (1) $0.9 \geqq x$, (2) $x \geqq y \geqq 0.2x$, (3) $1.4 \geqq x+y \geqq 0.8$

11 Claims, 12 Drawing Sheets x+y>1 x+y=1 x+y<1 x>y x+y>1 x>y x+y=1 x>y x+y<1

CONTACT FOR VACUUM INTERRUPTER AND VACUUM INTERRUPTER USING THE CONTACT

BACKGROUND OF THE INVENTION

The present invention relates to a contact for a vacuum interrupter and a vacuum interrupter using the contact.

For the purpose of improving an interruption performance or breaking capacity of the vacuum interrupter, it is required that arc is uniformly developed between the entire surfaces of electrodes without being concentrated onto local areas of the electrode surfaces upon power interruption. A vacuum interrupter of an axial magnetic field application type has been adopted to receive arc by the entire surfaces of the electrodes. The vacuum interrupter of such a type as described above produces an axial magnetic field between electrodes in the axial direction thereof during interruption. Owing to the production of the axial magnetic field, the developed arc is confined by the axial magnetic field so that loss of charged particles in an arc column can be reduced. This makes the arc stable and suppresses temperature rise at the electrodes, serving for improving the interruption performance.

U.S. Pat. No. 4,620,074 (corresponding to Japanese Patent Application Second Publication No. 3-59531) discloses a contact arrangement for vacuum switches. The arrangement includes two opposed cup-type contacts having hollow cylindrical contact carriers. Each contact carrier has a contact plate on the end surface thereof and a plurality of slots on the circumferential surface thereof. The slots are inclined with respect to a center axis of each contact carrier. The axial length (cup depth) of the contact carrier, the number of slots, the azimuth angle of the slots relative to an outer diameter of the contact carrier are specified.

SUMMARY OF THE INVENTION

For the purpose of obtaining the interruption performance of the vacuum interrupter at high voltage and large current, both of the diameter of the contacts and the gap (dissociation distance) between the contacts must be increased. In the above-described related art, if the diameter of the contacts and the gap therebetween are increased, a magnetic flux density between the electrodes will decrease to cause unstable arc between the electrodes so that the interruption operation will fail. In addition, if the azimuth angle of the slots of the contact carriers is set large in order to ensure the magnetic field generated between the electrodes, the contacts will be deteriorated in strength to cause deformation due to application of the force upon the switching on and off operation of the vacuum interrupter. This leads to deterioration in withstand voltage performance and interruption performance of the vacuum interrupter.

It would threrefore be desirable to provide a contact for a vacuum interrupter which is enhanced in magnetic field intensity without being deteriorated in mechanical strength. Further, it would be desirable to provide a vacuum interrupter using the contact, which can provide uniform distribution of the arc generated upon interruption and attain high interruption performance without increasing the size.

In one aspect of the present invention, there is provided a contact for a vacuum interrupter, comprising:

a hollow cylindrical contact carrier including a center axis, opposed axial end faces and an axial length extending along the center axis;

a contact plate disposed on one of the opposed axial end faces of the contact carrier;

a plurality of first slits extending from the one of the opposed axial end faces of the contact carrier and inclined with respect to the center axis of the contact carrier, the first slits having a first height x extending in the axial direction of the contact carrier; and a plurality of second slits extending from the other of the axial end faces of the contact carrier and inclined with respect to the center axis of the contact carrier, the second slits having a second height y extending in the axial direction of the contact carrier, the second slits cooperating with the first slits to define a coil portion in the contact carrier therebetween which allows a current to flow and form an axial magnetic field along the axial direction of the contact carrier, wherein assuming that the axial length of the contact carrier is 1, the first height x and the second height y satisfies a relationship given by the following expressions (1)–(3):

$$0.9 \geqq x \quad (1)$$

$$x \geqq y \geqq 0.2x \quad (2)$$

$$1.4 \geqq x+y \geqq 0.8 \quad (3)$$

In a further aspect of the present invention, there is provided a A vacuum interrupter, comprising:

a vacuum envelope; and a pair of contacts arranged coaxially and relatively moveably in the axial direction within the vacuum envelope, each of the contacts comprising:

a hollow cylindrical contact carrier including a center axis, opposed axial end faces and an axial length extending along the center axis;

a contact plate disposed on one of the opposed axial end faces of the contact carrier;

a plurality of first slits extending from the one of the opposed axial end faces of the contact carrier and inclined with respect to the center axis of the contact carrier, the first slits having a first height x extending in the axial direction of the contact carrier; and a plurality of second slits extending from the other of the axial end faces of the contact carrier and inclined with respect to the center axis of the contact carrier, the second slits having a second height y extending in the axial direction of the contact carrier, the second slits cooperating with the first slits to define a coil portion in the contact carrier therebetween which allows a current to flow and form an axial magnetic field along the axial direction of the contact carrier, wherein assuming that the axial length of the contact carrier is 1, the first height x and the second height y satisfies a relationship given by the following expressions (1)–(3):

$$0.9 \geqq x \quad (1)$$

$$x \geqq y \geqq 0.2x \quad (2)$$

$$1.4 \geqq x+y \geqq 0.8 \quad (3)$$

DETAILED DESCRIPTION OF THE PREFERRED EMBODIMENT

Figure 1:
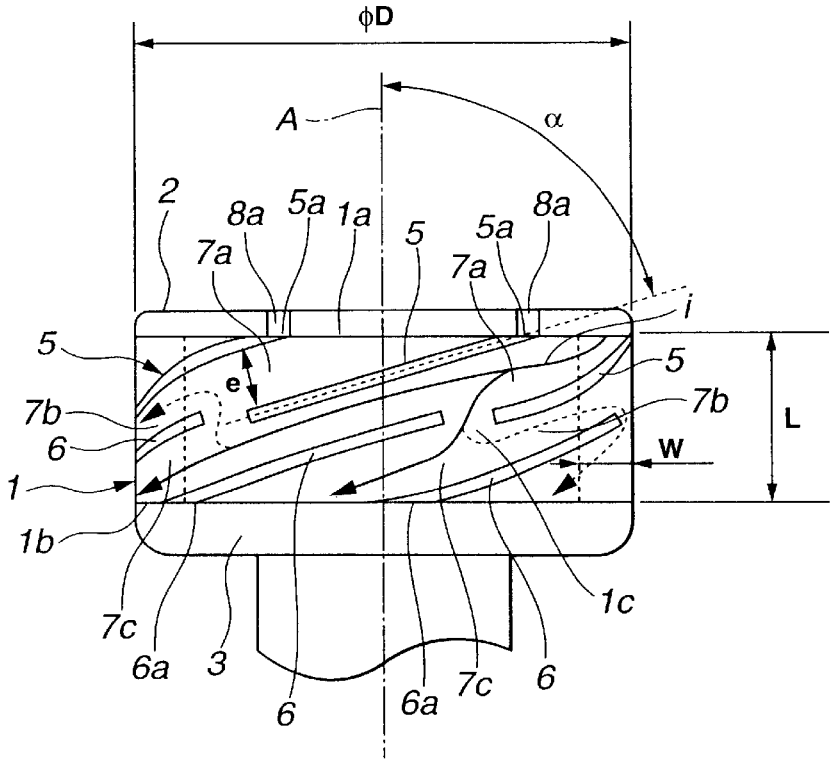
FIG. 1 is a side view of a contact used for a vacuum interrupter according to a first embodiment of the present invention.
Figure 2:
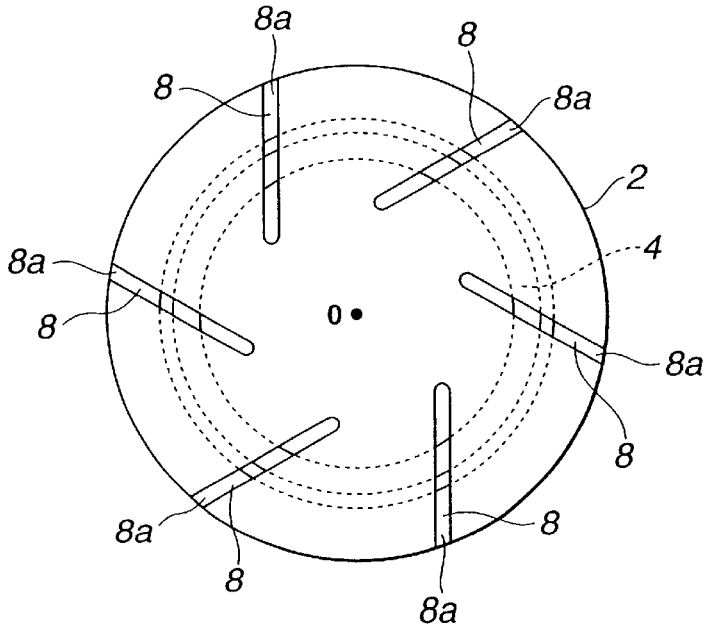
FIG. 2 is a top plan view of the contact shown in FIG. 1.
Figure 4:
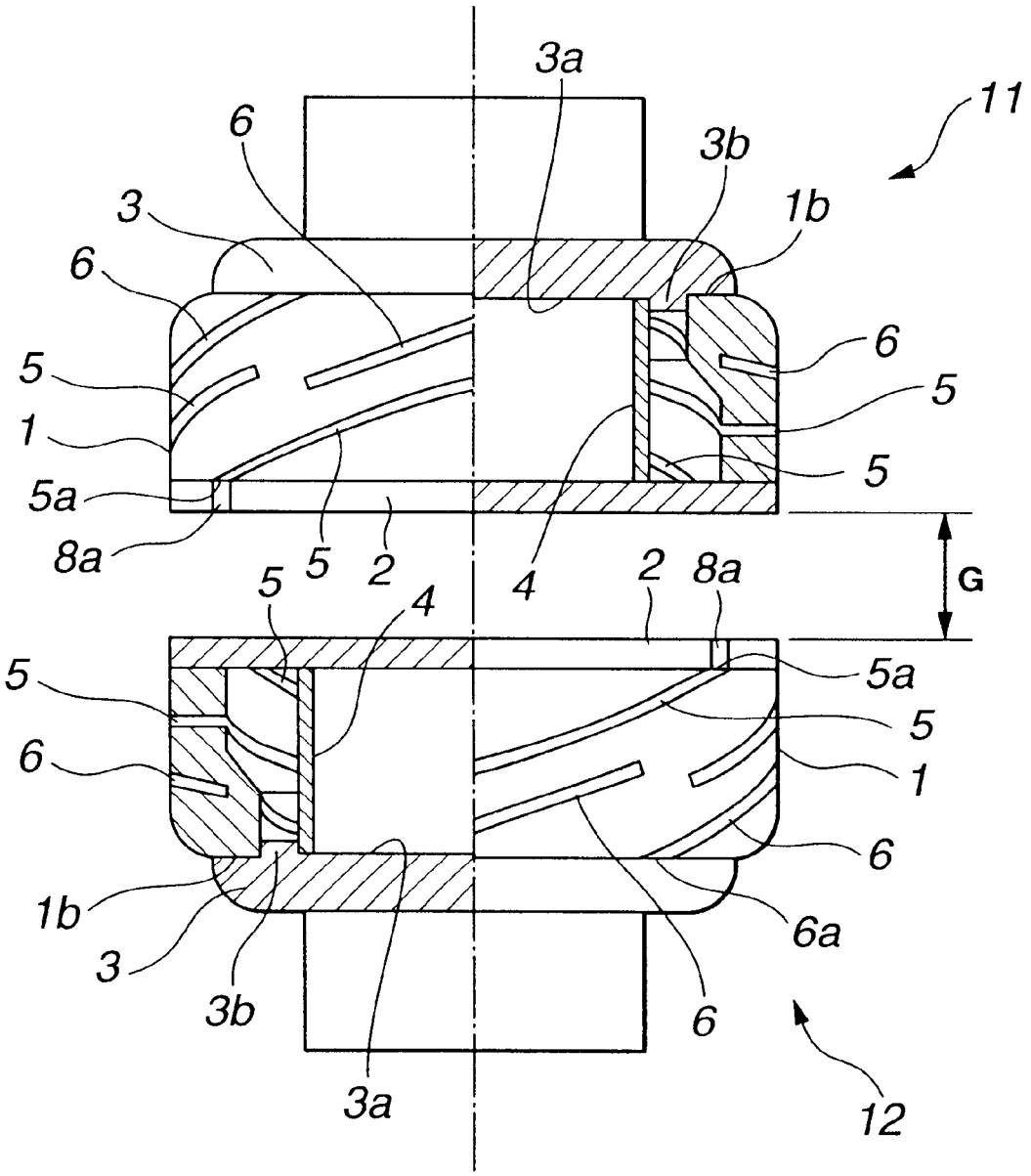
FIG. 4 is a side view of a pair of opposed contacts, partially in section, used in the vacuum interrupter, each being the same as the contact shown in FIG. 1.
Figure 5:
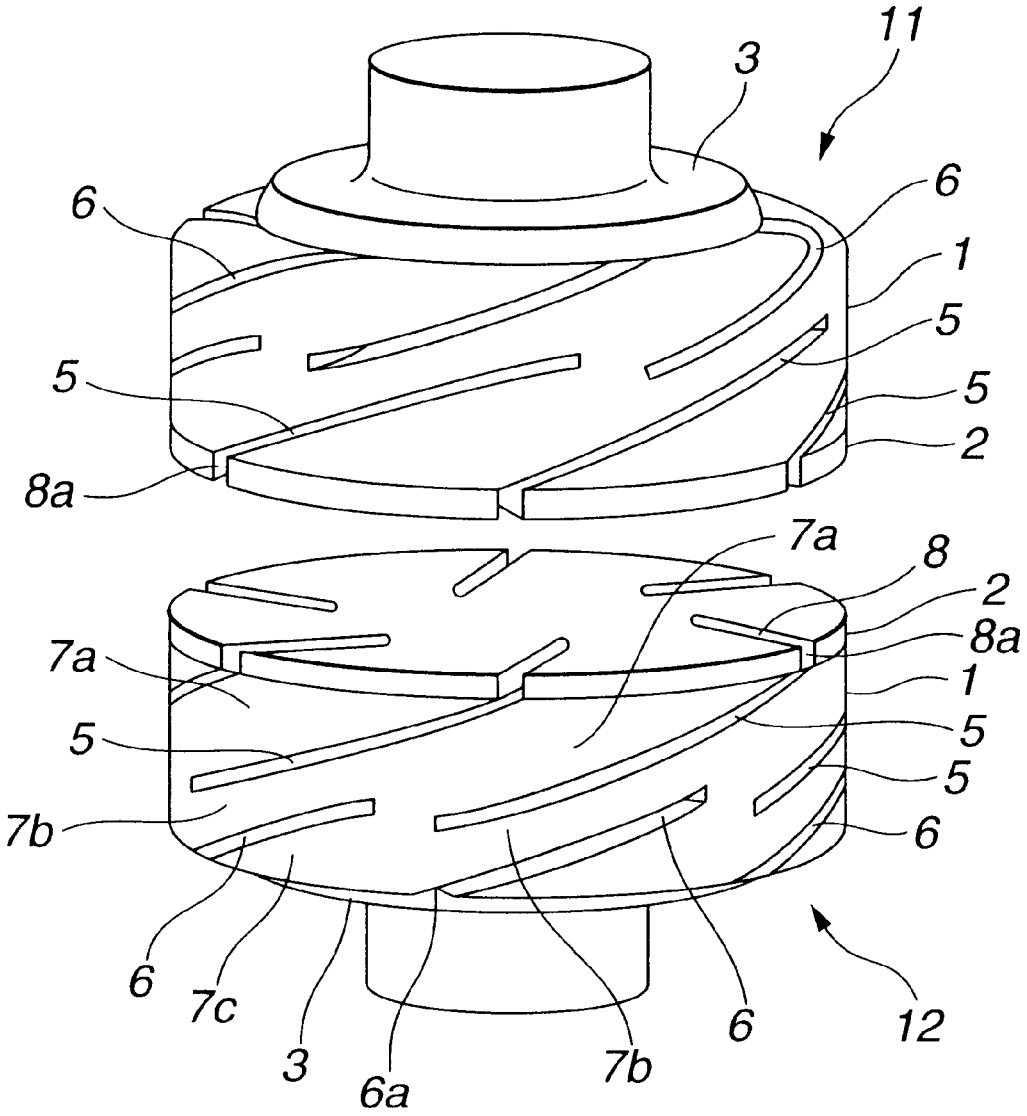
FIG. 5 is a perspective view of the opposed contacts shown in FIG. 4.

Referring to the drawings, a description is made with respect to a contact for a vacuum interrupter and a vacuum interrupter using same, according to the present invention. Referring to FIGS. 1–2, there is shown the contact according to an embodiment of the present invention. Referring to FIGS. 4–5, there is shown two opposed contacts used in the vacuum interrupter. As seen from FIGS. 1 and 2, the contact includes a hollow cylindrical contact carrier 1 having a center axis A. In FIG. 1, D, L and W denote an outer diameter of the contact carrier 1, an axial length or depth of the contact carrier 1 and a thickness of a cylindrical wall of the contact carrier 1, respectively. As illustrated in FIG. 1, the contact carrier 1 includes opposed axial end faces 1*a* and 1*b*. A contact plate 2 is fixed to the end face la of the contact carrier 1 by brazing. A contact end plate 3 is fixed to the opposite end face 1*b* of the contact carrier 1 by brazing. The cylindrical contact carrier 1 and the contact end plate 3 cooperate to form a cup shape. In this embodiment, as illustrated in FIG. 4, the contact end plate 3 has a ring-shaped fitting 3*b* on a surface 3*a* thereof. The fitting 3*b* is fitted into a recess formed in the end face 1*b* of the contact carrier 1 and brazed thereto. A hollow cylindrical reinforcing member 4 is coaxially disposed inside the contact carrier 1 and extends along an inner circumferential surface of the contact carrier 1 with a space therebetween. The reinforcing member 4 reinforces the contact carrier 1 and the contact plate 2 to prevent deformation thereof. The reinforcing member 4 includes an axial end portion which is fitted to an inner periphery of the ring-shaped fitting 3*b* and contacted with the surface 3*a* of the contact end plate 3. The reinforcing member 4 includes an opposite axial end portion having an axial end face which is in contact with the contact plate 2 and brazed thereto.

Figure 3:
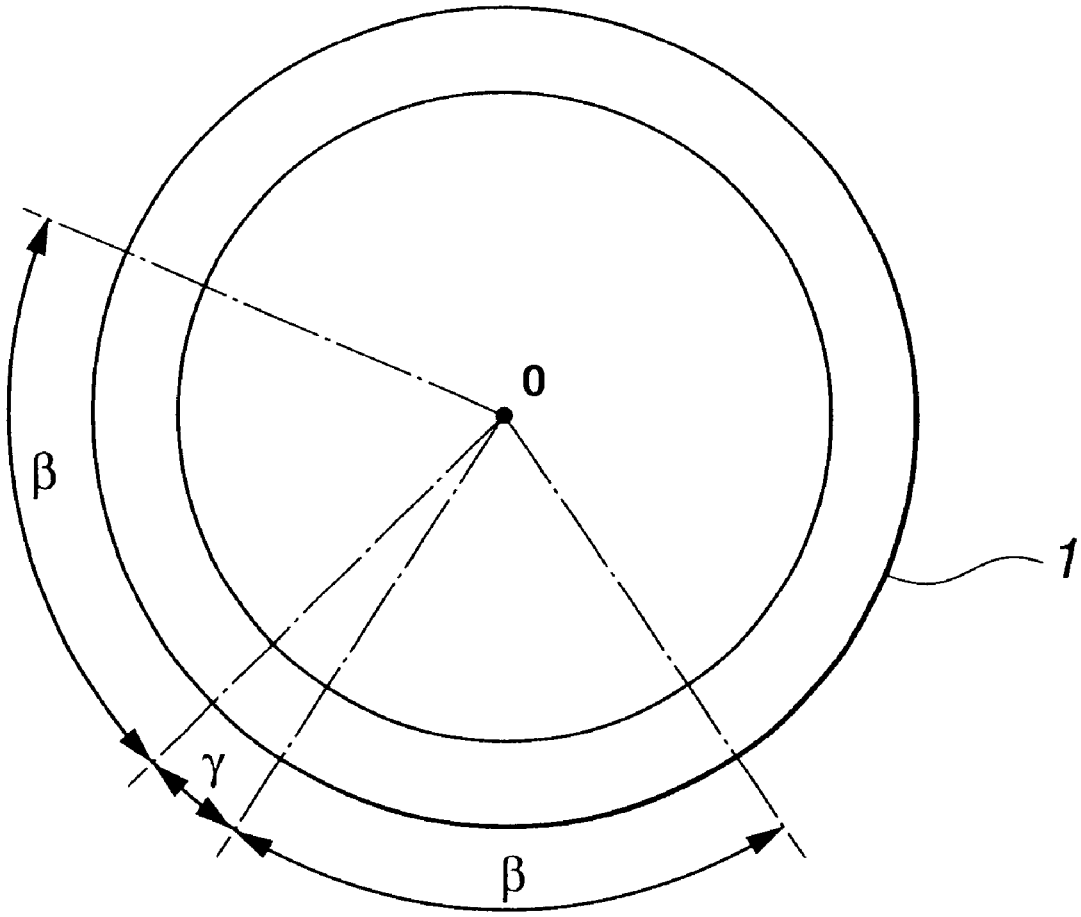
FIG. 3 is an explanatory diagram of azimuth angle of the contact shown in FIG. 1.

The contact carrier 1 includes first slits 5 and second slits 6 formed in the cylindrical wall thereof. The first slits 5 and the second slits 6 extend between the inner and outer circumferential surfaces of the contact carrier 1. The first slits 5 and the second slits 6 are inclined at an angle a relative to the center axis A of the contact carrier 1. The first slit 5 has an end 5*a* open to the end face 1*a* of the contact carrier 1. The second slit 6 has an end 6*a* open to the opposite end face 1*b* of the contact carrier 1. The first slits 5 and the second slits 6 have an azimuth angle β set at constant. As illustrated in FIG. 3, the azimuth angle β is an opening angle of each of the arcuate slits 5 and 6 with respect to a center O of each of the circular end faces 1*a* and 1*b*. The first slits 5 and the second slits 6 cooperate to define a coil portion in the contact carrier 1 therebetween. Specifically, a coil portion 7*a* is formed between the first slits 5 adjacent to each other, a coil portion 7*b* is formed between the first slit 5 and the second slit 6, and a coil portion 7*c* is formed between the second slits 6 adjacent to each other.

The total number S of first slits 5 and second slits 6 is set within a range given by the following expression:

$$0.1D \leqq S \leqq 0.2D$$

wherein D indicates the outer diameter (in the unit of mm) of the contact carrier 1. Each of the number of first slits 5 and the number of second slits 6 is a half of the total number S. The inclination angle a of the first slits 5 and the second slits 6 is set within a range from 60 degrees to 80 degrees. The range of the inclination angle α is determined in terms of mechanical strength and resistance reduction of the contact carrier 1. Specifically, from the viewpoint of mechanical strength and resistance reduction of the contact carrier 1, a vertical distance "e" extending between the adjacent slits 5, between the adjacent slits 6, and between the adjacent slits 5 and 6 in a direction perpendicular thereto is preferably about 7 mm to 18 mm. In such a case, the range of the inclination angle a, i.e., 60 degrees to 80 degrees, is obtained based on the diameter D of the contact carrier 1 and the total number S of slits 5 and 6.

The azimuth angle β of the first slits 5 and the second slits 6 is set within a range of $(540/S)° \leqq \beta \leqq (1440/S)°$, wherein S indicates the total number S of first slits 5 and second slits 6. The lower limit value (540/S)° is determined in a case where the length of the coil portion is 1.5 turns. If the lower limit value is less than (540/S)°, a sufficient magnetic flux cannot be generated. The upper limit value (1440/S)° is determined in a case where the length of the coil portion is 4 turns. If the upper limit value is more than (1440/S)°, the resistance will increase to generate heat which causes adverse influence. Further, in such a case, the mechanical strength of the contact carrier 1 will be reduced.

The first slits 5 and the second slits 6 are equidistantly spaced from each other by a predetermined circumferential distance or azimuth angle γ. The azimuth angle γ is set within a range of $(120/S)° \leqq \gamma \leqq (600/S)°$, wherein S indicates the total number S of first slits 5 and second slits 6. The range of azimuth angle γ is determined in terms of the mechanical strength of the contact carrier 1.

Circumferential lengths of the first slits 5 and the second slits 6 are reduced to define the circumferential distance or azimuth angle γ therebetween. As a result, a solid pillar portion 1*c* is formed between the adjacent first slits 5 and between the adjacent second slits 6. With the provision of the pillar portion 1*c*, the mechanical strength of the contact carrier 1 can be maintained. Specifically, if a circumferentially extended slit is formed in the contact carrier 1, the mechanical strength of the contact carrier 1 will be deteriorated in the axial direction. However, owing to the provision of the solid pillar portion 1*c*, the axial strength of the contact carrier 1 can be maintained.

The first slit 5 and the second slit 6 may overlap each other within a predetermined region extending in the axial direction of the contact carrier 1. The second slit 6 may be formed such that a portion thereof is located between the two adjacent first slits 5. As best shown in FIG. 2, the contact plate 2 is formed with linear slits 8 straightly inwardly extending from an outer periphery thereof. The number of slits 8 is the same as the number of first slits 5. The slits 8 have inner ends offset from the center O of the contact plate 2 and outer ends 8*a* open to the circumferential surface of the contact plate 2. The slits 8 are arranged in a spiral fashion as a whole as shown in FIG. 2. The contact plate 2 is mounted to the contact carrier 1 by aligning the outer ends 8*a* of the slits 8 with the open ends 5*a* of the first slits 5 of the contact carrier 1. The slits 8 and the first slits 5 are thus communicated with each other.

Figure 6:
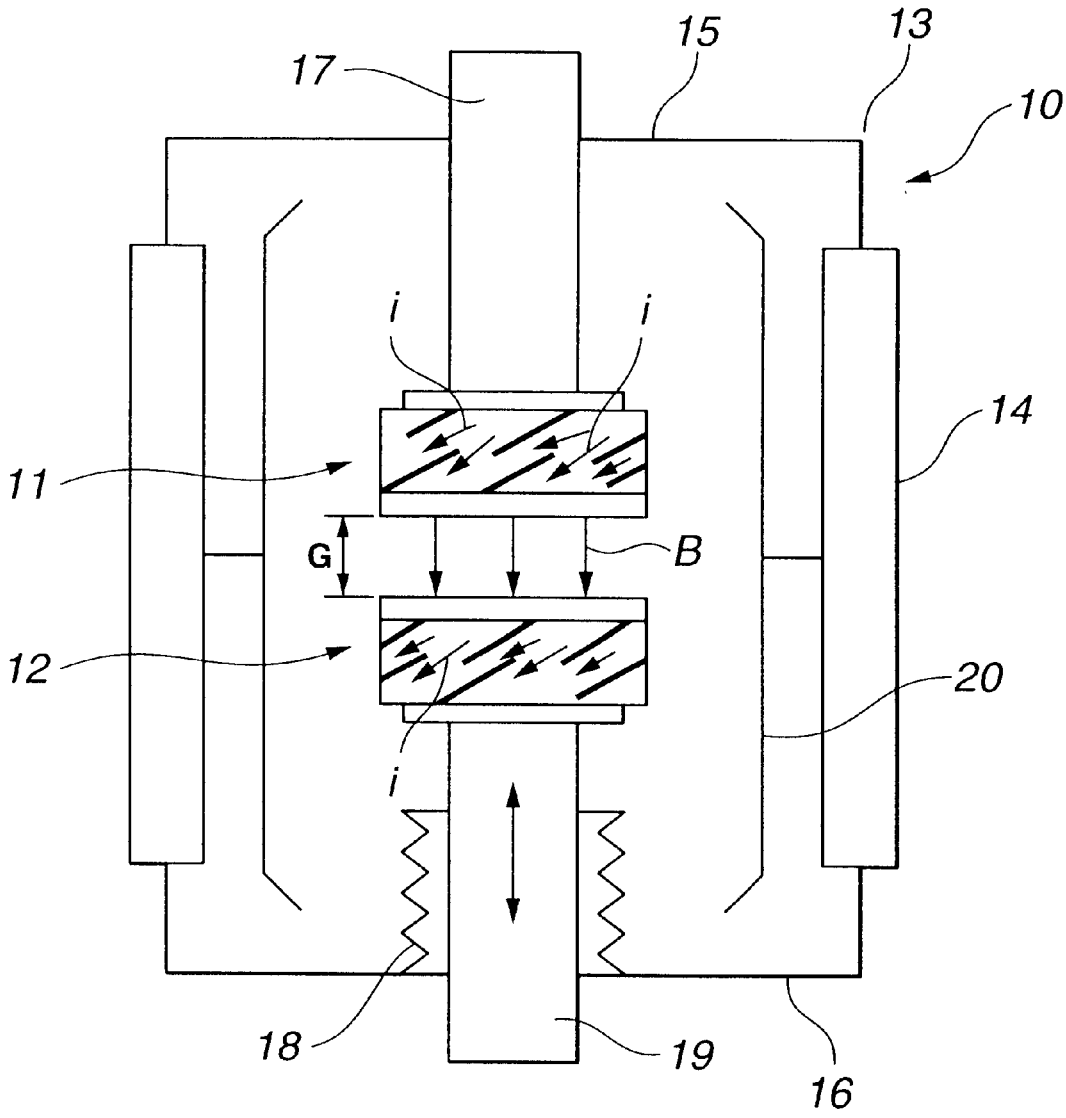
FIG. 6 is a schematic diagram of the vacuum interrupter using the contacts shown in FIG. 4.

Referring now to FIGS. 4–6, a vacuum interrupter using the above-described contact is explained. As illustrated in FIG. 6, the vacuum interrupter 10 includes a vacuum envelope 13 and two contacts 11 and 12 disposed within the vacuum envelope 13. Each of the two contacts 11 and 12 has the structure shown in FIGS. 1–3. As illustrated in FIGS. 4–6, the contacts 11 and 12 are coaxially arranged and opposed to each other. There exists a predetermined gap (inter-contact distance) G between the contacts 11 and 12. The predetermined gap G is set within a range of 15 mm≦G≦100 mm. The predetermined gap G is empirically determined in terms of a voltage class to be applied across vacuum interrupter 10.

The vacuum envelope 13 includes an insulating tube 14 and end plates 15 and 16 closing opposed ends of the insulating tube 14. The insulating tube 14 is made of ceramic, glass or the like. The end plates 15 and 16 are made of metal. The vacuum envelope 13 is evacuated to produce a high vacuum. A stationary electrode rod 17 is secured to the vacuum envelope 13 through the end plate 15. The contact 11 as a stationary electrode is fixed to a tip of the stationary electrode rod 17 which is located inside the vacuum envelope 13. A moveable electrode rod 19 is mounted to the vacuum envelope 13 through the end plate 16. The moveable electrode rod 19 is operated by a bellows 18 coupled therewith, so as to move relative to the stationary electrode rod 17 in the axial direction of the contacts 11 and 12. The contact 12 as a moveable electrode is fixed to a tip of the moveable electrode rod 19 which is opposed to the tip of the stationary electrode rod 17 within the vacuum envelope 13. A shield 20 is disposed around the contacts 11 and 12 within the vacuum envelope 13.

Upon interruption of a current in the thus-constructed vacuum interrupter 10, arc is produced between the contacts 11 and 12 as electrodes. The current "i" flows as indicated by arrows in FIGS. 1 and 6. Specifically, as illustrated in FIG. 1, the current "i" enters from the contact plate 2 into the coil portion 7*a* between the adjacent first slits 5 of the contact carrier 1, passing through the coil portion 7*b* between the first slit 5 and the second slit 6 and the coil portion 7*c* between the adjacent second slits 6. Owing to passage of the current "i" through the coil portions 7*a*, 7*b* and 7*c*, an axial magnetic field B between the contact plates 2 is generated. With thus-formed numerous and long current paths, the magnetic field B is about twice as much as that generated between the contacts having only the first slits 5. Therefore, the vacuum interrupter can attain excellent arc stability and interruption performance. Meanwhile, a bypass flow of the current may be allowed as indicated by broken lines in FIG. 1.

Upon taking a magnetic field generated between two spaced electrodes into consideration, a magnetic field generated between the contact plates 2 of the contacts 11 and 12 due to the first slits 5 more effectively acts on vacuum arc than that due to the second slits 6. This is because the first slits 5 on the side of the contact plate 2 are located much closer to the gap between the electrodes than the second slits 6 on the side of the contact end plate 3. If the first slits 5 and the second slits 6 have a same axial length (referred to as a height hereinafter) extending in the axial direction of the contact carrier 1, an optimal magnetic field will not be always obtained. For the reason, various contacts prepared with different heights of the first and second slits 5 and 6 were tested to measure intensity of a magnetic field generated therebetween.

Figure 7A:
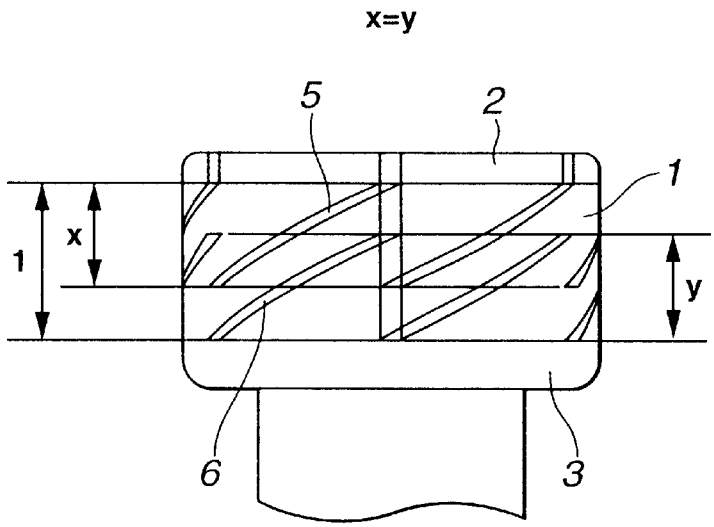
FIGS. 7A–7C are side views of the contacts, schematically showing different arrangements of slits having same size, respectively.
Figure 7B:
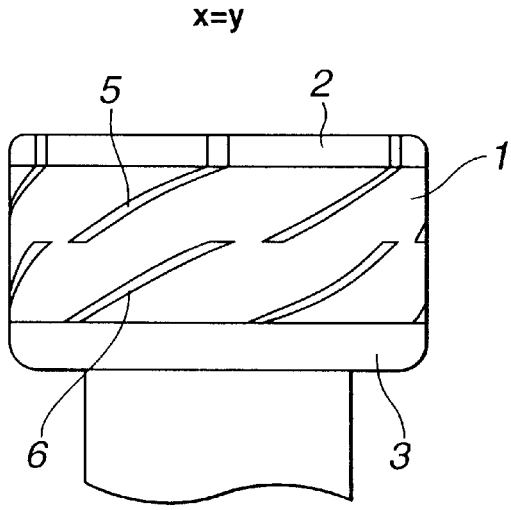
Figure 7C:
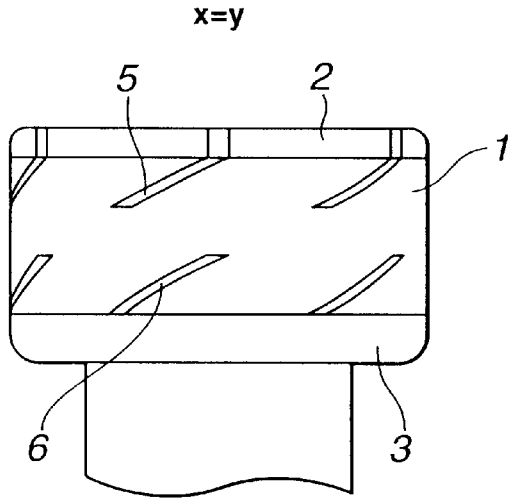

Referring to FIGS. 7A–7C, 8A–8C and 9–13, the magnetic field intensity between the contacts is explained. FIGS. 7A–7C illustrate the contacts having different arrangements of the first and second slits 5 and 6 in which a ratio of a sum of heights of the first and second slits 5 and 6 relative to the axial length of the contact carrier 1 are changed. In FIGS. 7A–7C, "x" and "y" denote the height of the first slits 5 and the height of the second slits 6, respectively, and the axial length of the contact carrier 1 is assumed to be 1. Here, $0<x$, $y<1$ and $x=y$. The parameters of shapes of the first and second slits 5 and 6 are represented by the heights x and y of the first and second slits 5 and 6 and the sum x+y of heights x and y thereof. FIGS. 7A–7C show the cases in which the heights x and y of the first and second slits 5 and 6 are equal, and the sum x+y of heights x and y is changed relative to the axial length "1" of the contact carrier 1. FIG. 7A shows the case of $x+y>1$, in which the sum x+y of heights x and y of the first and second slits 5 and 6 is larger than the axial length "1" of the contact carrier 1. Namely, the first and second slits 5 and 6 overlap in the height direction. FIG. 7B shows the case of $x+y=1$, in which the sum x+y of heights x and y of the first and second slits 5 and 6 is equal to the axial length "1" of the contact carrier 1. Namely, the first and second slits 5 and 6 have no overlap in the height direction. FIG. 7C shows the case of $x+y<1$, in which the sum x+y of heights x and y of the first and second slits 5 and 6 is smaller than the axial length "1" of the contact carrier 1. Namely, the first and second slits 5 and 6 are spaced from each other in the height direction.

Figure 8A:
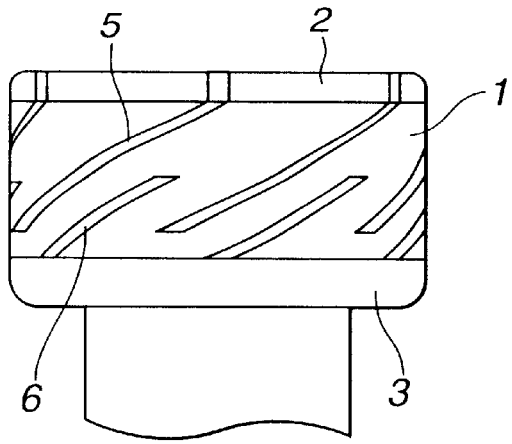
FIGS. 8A–8C are views similar to FIGS. 7A–7C, but showing different arrangements of the slits different in size, respectively.
Figure 8B:
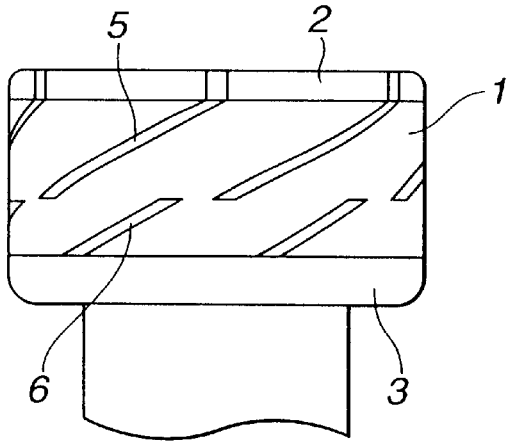
Figure 8C:
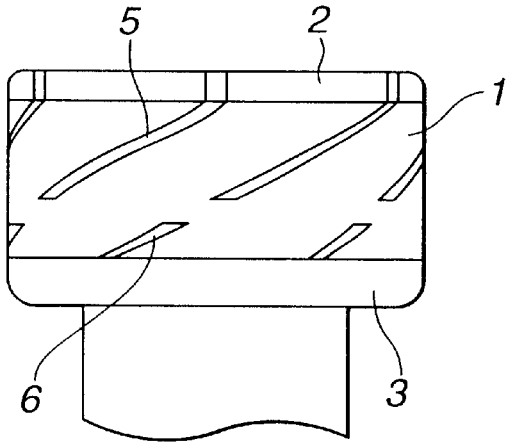

FIGS. 8A–8C are illustrations similar to FIGS. 7A–7C, but showing the case of $x>y$ in which the height x of the first slits 5 is larger than the height y of the second slits 6. FIG. 8A shows the case of $x+y>1$, in which the first and second slits 5 and 6 overlap in the height direction. FIG. 8B shows the case of $x+y=1$, in which the first and second slits 5 and 6 have no overlap in the height direction. FIG. 8C shows the first and second slits 5 and 6 are spaced from each other in the height direction.

Figure 9:
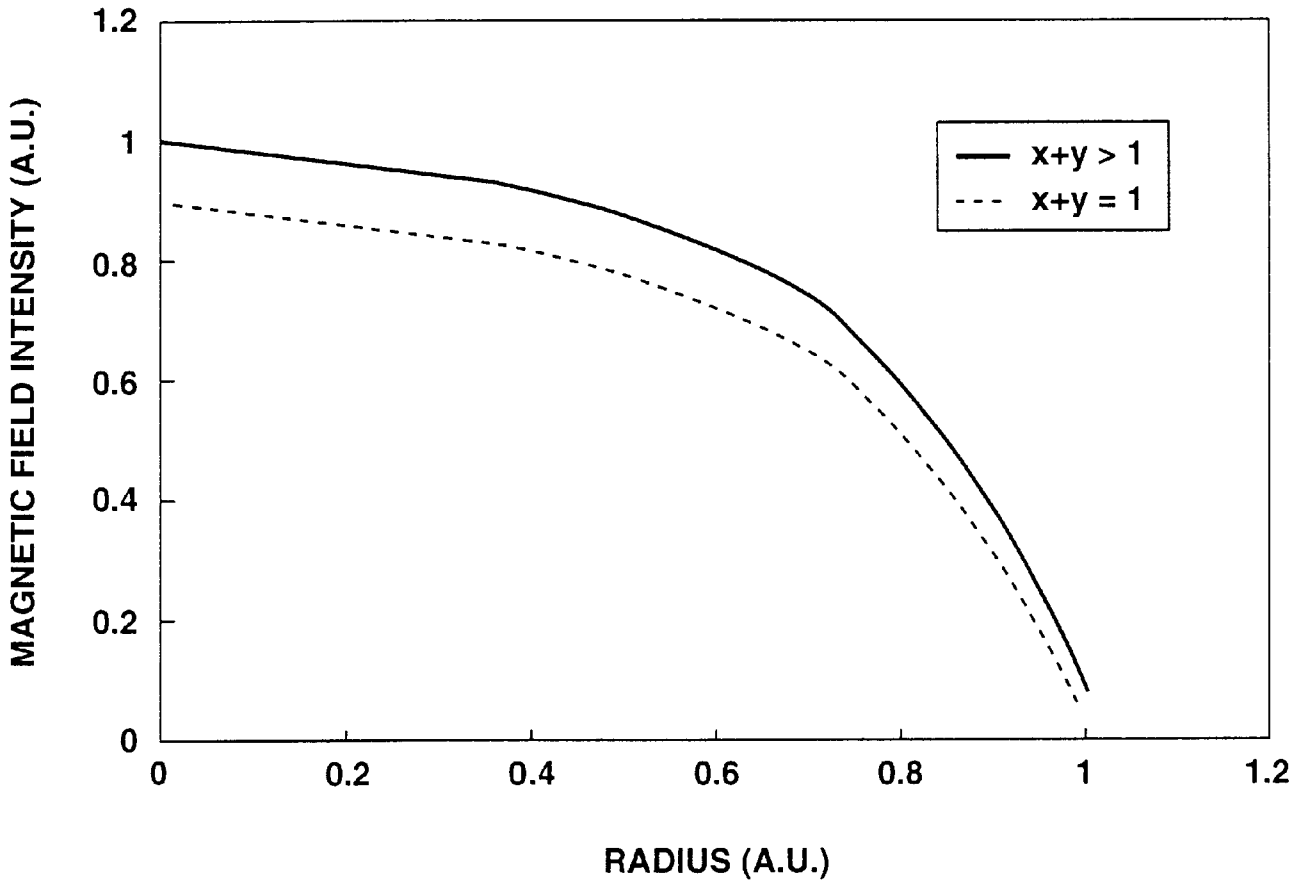
FIG. 9 is a graph showing distribution of a magnetic field intensity obtained in the contacts of FIGS. 7A–7B.
Figure 10:
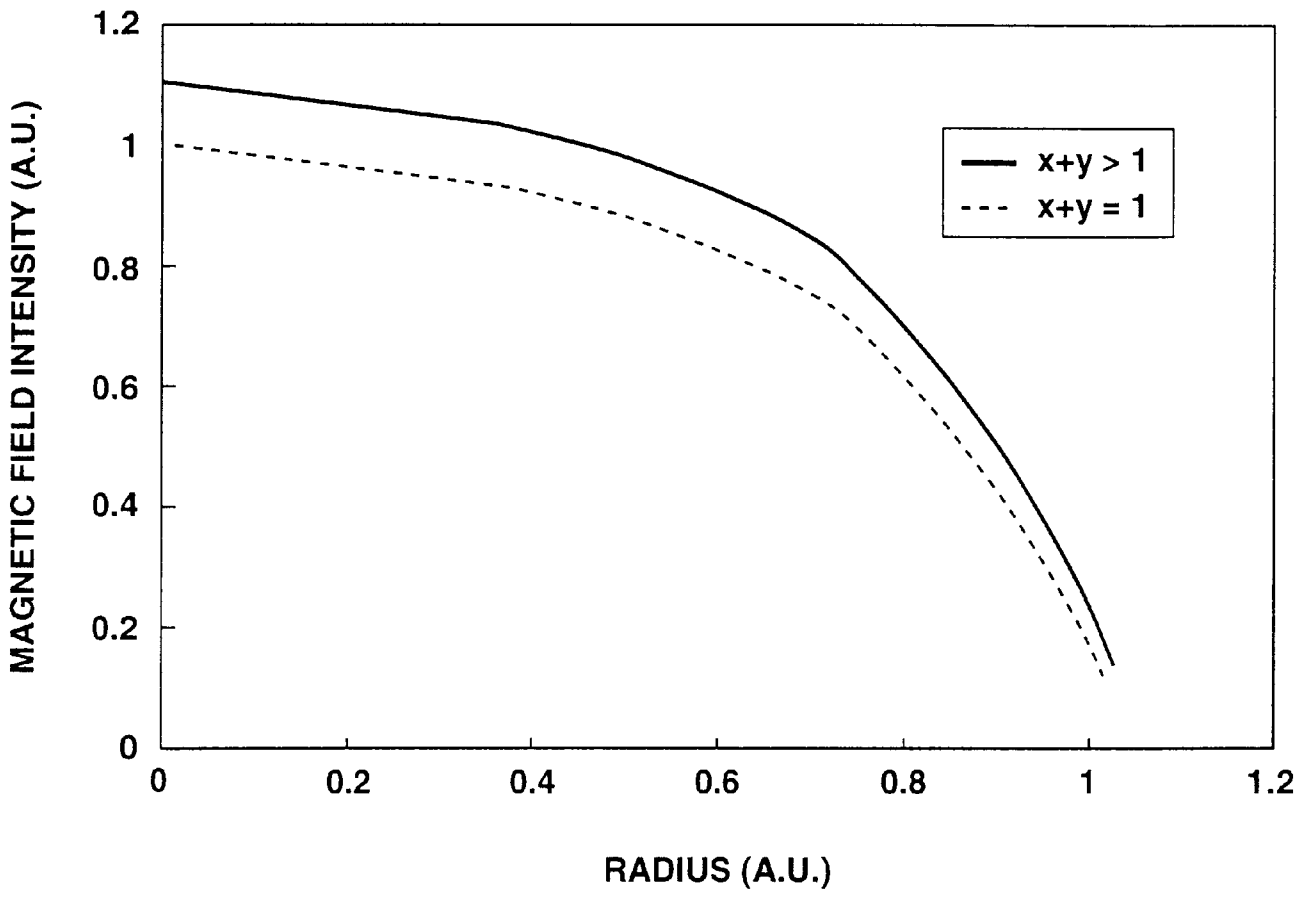
FIG. 10 is a graph showing distribution of a magnetic field intensity obtained in the contacts of FIGS. 8A–8B.

FIG. 9 illustrates distribution of an intensity of the magnetic field generated in the vacuum interrupter using the contacts shown in FIGS. 7A–7B. FIG. 10 illustrates distribution of an intensity of the magnetic field generated in the vacuum interrupter using the contacts shown in FIGS. 8A–8B. In FIGS. 9 and 10, axis of abscissa denotes a radial distance from the center axis A of the contact plate 2 as an electrode, and axis of ordinate denotes an intensity of the magnetic field generated between the contacts. Arbitrary unit (A.U.) is used. Specifically, FIG. 9 shows distribution of the magnetic field intensity obtained in a case where the heights x and y of the first and second slits 5 and 6 are identical, namely, $x=y$. FIG. 10 shows distribution of the magnetic field intensity obtained in a case where the height x of the first slits 5 is larger than the height y of the second slits 6, namely, $x>y$. In FIGS. 9 and 10, the solid line indicates the distribution of the magnetic field intensity obtained in the case of x+y>1. In such a case, the sum x+y of heights x and y of the first and second slits 5 and 6 is larger than the axial length "1" of the contact carrier 1, so that the first and second slits 5 and 6 overlap in the height direction. The broken line indicates the distribution of the magnetic field intensity obtained in the case of x+y=1. In such a case, the sum x+y of heights x and y of the first and second slits 5 and 6 is equal to the axial length "1" of the contact carrier 1, so that there is no overlap between the first and second slits 5 and 6 in the height direction. As seen from FIGS. 9 and 10, the distribution of the magnetic field intensity obtained in the case of x+y>1 is greater than that of the magnetic field intensity obtained in the case of x+y=1.

Figure 11:
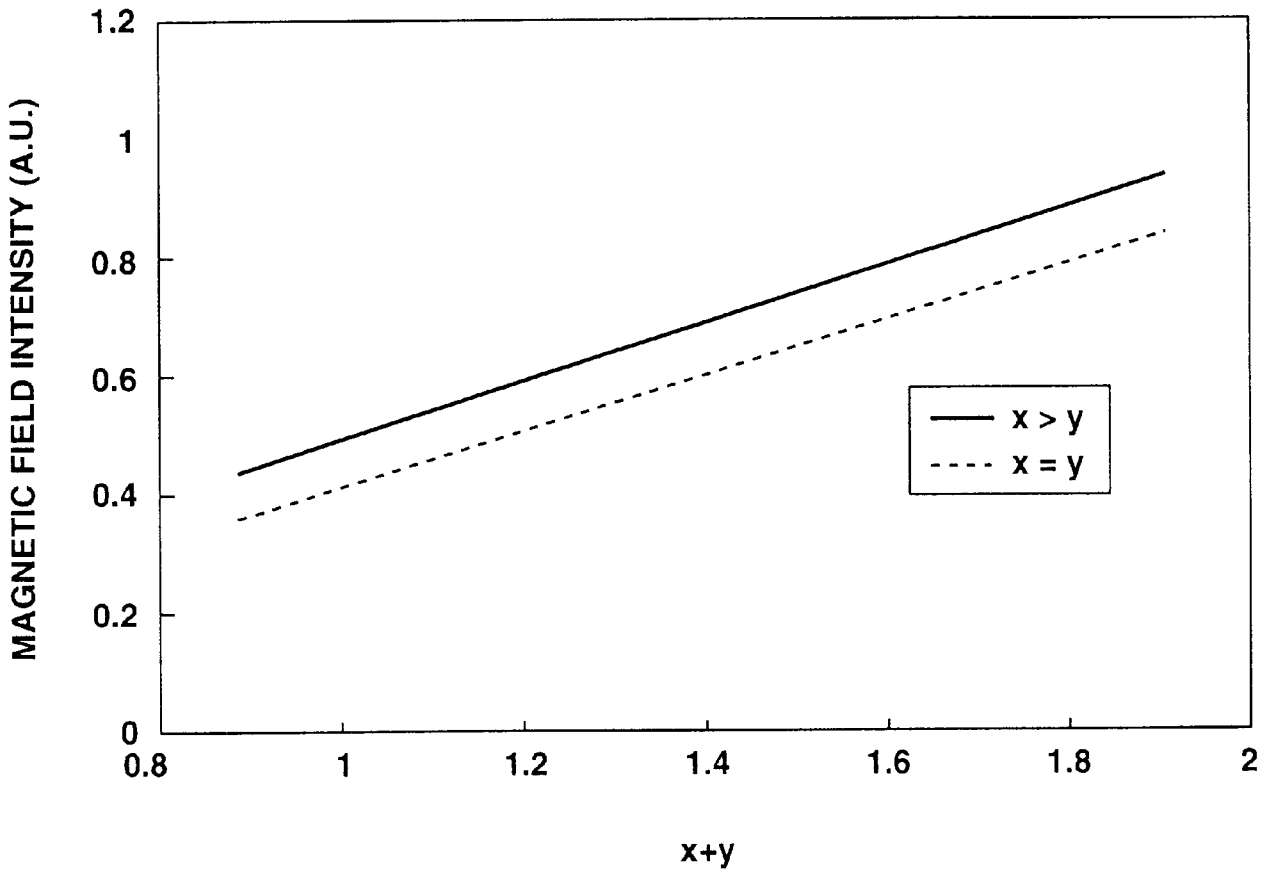
FIG. 11 is a graph showing a relationship between slit size and magnetic field intensity obtained in the contact.

FIG. 11 shows a relationship between a sum x+y of heights x and y of the first and second slits 5 and 6 of the contacts and an intensity of the magnetic field generated between the contacts. Axis of abscissa denotes the sum x+y of heights x and y of the first and second slits 5, and axis of ordinate denotes the intensity of the magnetic field generated between the contacts. The solid line indicates the magnetic field intensity obtained in the case of x>y in which the height x of the first slits 5 is larger than the height y of the second slits 6. The broken line indicates the magnetic field intensity obtained in the case of x=y in which the heights x and y of the first and second slits 5 and 6 are equal to each other.

Figure 12:
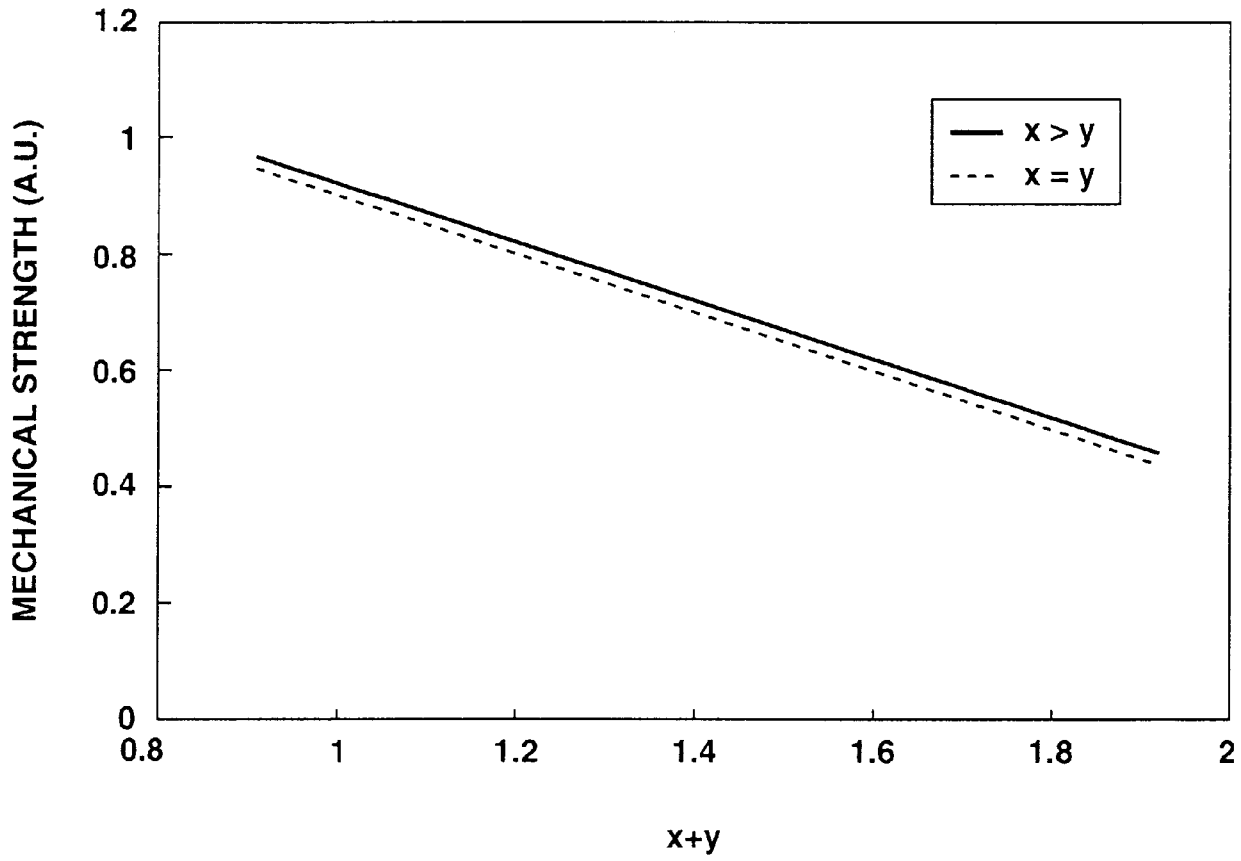
FIG. 12 is a graph showing a relationship between slit size and mechanical strength of the contact.

FIG. 12 shows a relationship between a sum x+y of heights x and y of the first and second slits 5 and 6 of the contacts and a mechanical strength of each of the contacts. Axis of abscissa denotes the sum x+y of heights x and y of the first and second slits 5, and axis of ordinate denotes the mechanical strength of each of the contacts. The solid line indicates the magnetic field intensity obtained in the case of x>y. The broken line indicates the magnetic field intensity obtained in the case of x=y. As seen from FIGS. 11 and 12, the mechanical strength obtained in the case of x>y is substantially the same as that obtained in the case of x=y, but the magnetic field intensity obtained in the case of x>y is greater than that obtained in the case of x=y.

Figure 13:
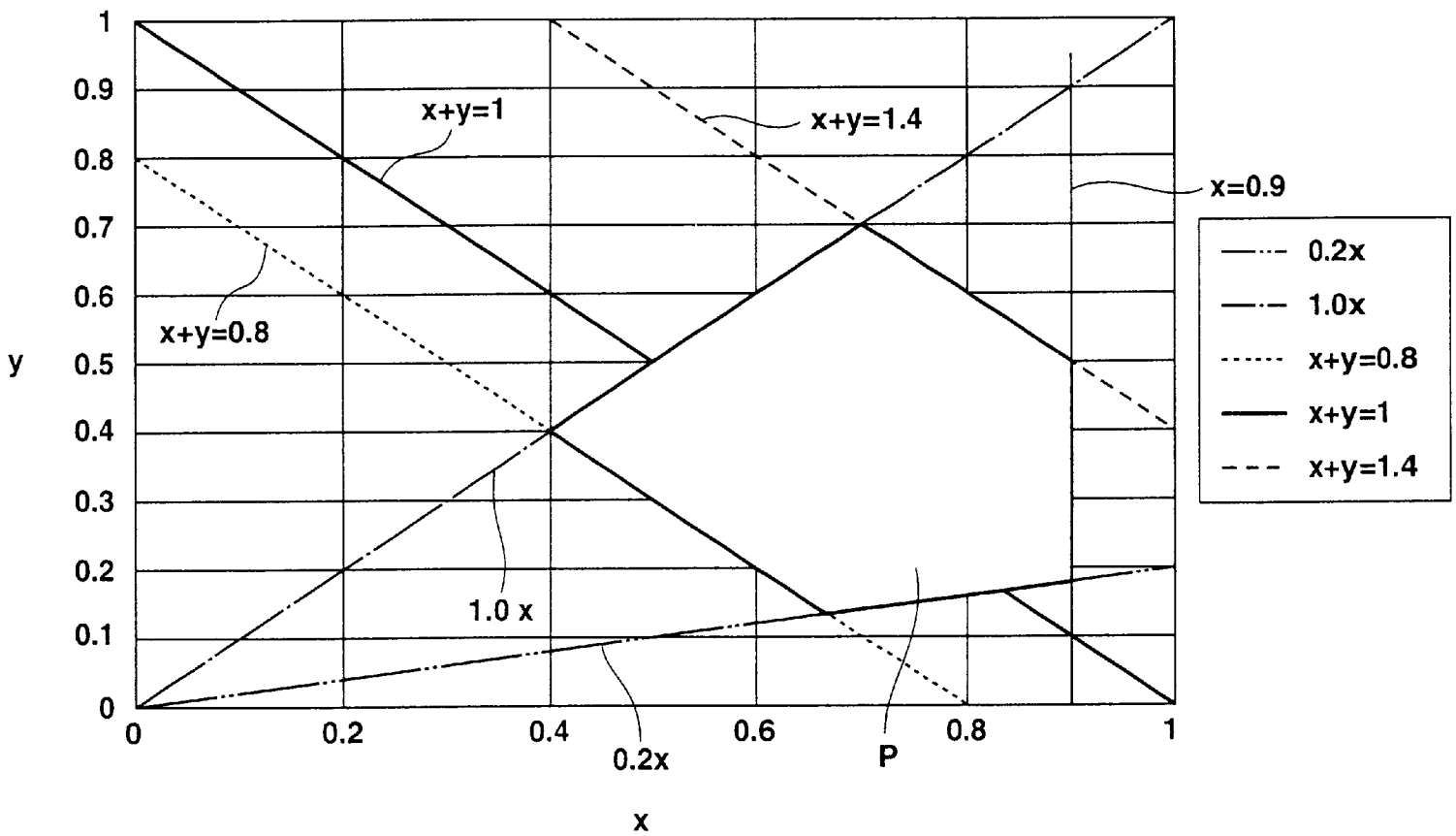
FIG. 13 is a graph showing a region of parameters of the slit size.

FIG. 13 shows a region P of the parameters represented by the heights x and y of the first and second slits 5 and 6 in which desired magnetic field intensity and mechanical strength can be obtained. In the region P, the heights x and y of the first and second slits 5 and 6 have a relationship given by the following expressions (1)–(3):

$$0.9 \geqq x \quad (1)$$

$$x \geqq y \geqq 0.2x \quad (2)$$

$$1.4 \geqq x+y \geqq 0.8 \quad (3)$$

The contact for a vacuum interrupter which is enhanced in magnetic field intensity and mechanical strength can be obtained by selecting the heights x and y of the first and second slits 5 and 6 within the region P. Specifically, the height x of the first slits 5 is set to a value equal to or larger than the height y of the second slits 6. Preferably, the height x of the first slits 5 is set to a value larger than the height y of the second slits 6. In such a case, more effective magnetic field acting on the arc between the contacts can be obtained as explained above. Further, the height y of the second slits 6 is set to a value equal to ⅕ of the height x of the first slits 5 (i.e., 0.2x). Further, the sum x+y of heights x and y of the first and second slits 5 and 6 is set to a value not more than 1.4. In this case, the first and second slits 5 and 6 overlap each other in the height direction. The sum x+y of heights x and y of the first and second slits 5 and 6 is set to a value not less than 0.8. In this case, the first and second slits 5 and 6 are spaced from each other with a slight gap in the height direction.

The contact carrier 1 may be further formed with a circumferential slit on the outer peripheral surface encountered with the end face 1*a*. The circumferential slit circumferentially extends and communicates with the first slit 5. Further, the contact carrier 1 may be formed with another circumferential slit on the outer peripheral surface encountered with the opposite end face 1*b*. The circumferential slit circumferentially extends and communicates with the second slit 6.

The vacuum interrupter of the present invention can provide extended current paths by setting the heights x and y of the first slits and the second slits 5 and 6 relative to the axial length of the contact carrier 1 within the above-described range. This enhances an intensity of the magnetic field generated between the contacts without deteriorating a mechanical strength of the contacts, serving for uniformly distributing the arc generated upon interruption and improving the interruption performance.

This application is based on prior Japanese Patent Applications No. 2001-276171 filed on Sep. 12, 2001, and No. 2001-293440 filed on Sep. 26, 2001, the entire contents of which are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A contact for a vacuum interrupter, comprising:

a hollow cylindrical contact carrier including a center axis, opposed axial end faces and an axial length extending along the center axis;

a contact plate disposed on one of the opposed axial end faces of the contact carrier;

a plurality of first slits extending from the one of the opposed axial end faces of the contact carrier and inclined with respect to the center axis of the contact carrier, the first slits having a first height x extending in the axial direction of the contact carrier; and a plurality of second slits extending from the other of the axial end faces of the contact carrier and inclined with respect to the center axis of the contact carrier, the second slits having a second height y extending in the axial direction of the contact carrier, the second slits cooperating with the first slits to define a coil portion in the contact carrier therebetween which allows a current to flow and form an axial magnetic field along the axial direction of the contact carrier, wherein assuming that the axial length of the contact carrier is 1, the first height x and the second height y satisfies a relationship given by the following expressions (1)–(3):

$$0.9 \geqq x \quad (1)$$

$$x \geqq y \geqq 0.2x \quad (2)$$

$$1.4 \geqq x+y \geqq 0.8 \quad (3)$$

2. The contact as claimed in claim 1, wherein the first height x and the second height y are equal to each other.

3. The contact as claimed in claim 2, wherein a sum of the first height x and the second height y is larger than 1.

4. The contact as claimed in claim 2, wherein a sum of the first height x and the second height y is equal to 1.

5. The contact as claimed in claim 2, wherein a sum of the first height x and the second height y is smaller than 1.

6. The contact as claimed in claim 1, wherein the first height x is larger than the second height y.

7. The contact as claimed in claim 6, wherein a sum of the first height x and the second height y is larger than 1.

8. The contact as claimed in claim 6, wherein a sum of the first height x and the second height y is equal to 1.

9. The contact as claimed in claim 6, wherein a sum of the first height x and the second height y is smaller than 1.

10. The contact as claimed in claim 1, wherein the contact plate comprises a plurality of third slits having one end open to a circumferential surface of the contact plate, the one end of the third slits being communicated with the first slits at the one of the opposed axial end faces of the contact carrier.

11. The contact as claimed in claim 1, further comprising a reinforcing member coaxially disposed inside the contact carrier, the reinforcing member being in contact with the contact plate and extending along the contact carrier.

* * * * *